United States Patent [19]

Kamei et al.

[11] 4,373,433

[45] Feb. 15, 1983

[54] METHOD AND APPARATUS FOR DEWATERING SCREENINGS

[75] Inventors: Shigeki Kamei; Masamori Fushio; Atuo Hirai, all of Amagasaki, Japan

[73] Assignee: Hitachi Kiden Kogyo, Ltd., Hyogo, Japan

[21] Appl. No.: 228,701

[22] Filed: Jan. 26, 1981

[51] Int. Cl.[3] ..... B30B 3/04

[52] U.S. Cl. ..... 100/37; 100/45; 100/47; 100/49; 100/51; 100/121; 100/139; 100/170; 100/156

[58] Field of Search ..... 100/35, 37, 43, 45, 100/47, 49, 50, 51, 121, 168, 170, 173, 176, 137, 138, 139, 156

[56] References Cited

U.S. PATENT DOCUMENTS 3,608,477 9/1971 Weber et al. ..... 100/156

4,126,088 11/1978 Thieme et al. ..... 100/121 X

FOREIGN PATENT DOCUMENTS 2615415 10/1976 Fed. Rep. of Germany ..... 100/121

2716666 10/1978 Fed. Rep. of Germany ..... 100/121

574073 3/1958 Italy ..... 100/121

1257470 12/1971 United Kingdom ..... 100/121

435269 11/1974 U.S.S.R. ..... 100/121

*Primary Examiner*—Peter Feldman

*Attorney, Agent, or Firm*—Wenderoth, Lind & Ponack

[57] ABSTRACT

A method and an apparatus for dewatering screenings collected at a sewage treatment plant or the like continuously and effectively by preliminary and secondary dewatering processes. Any alien substance mixed in the screenings such as stone, chips of wood, etc. which cannot be dewatered can be detected automatically and extracted immediately, without suspending the operation of the apparatus.

5 Claims, 10 Drawing Figures

METHOD AND APPARATUS FOR DEWATERING SCREENINGS

This invention relates to a method and an apparatus for effectively dewatering screenings and bulky refuse of comparatively high water content collected at a sewage treatment plant or the like.

An object of the present invention is to carry out a dewatering treatment continuously and effectively by providing a preliminary dewatering process preceding the principal dewatering of screenings and the like between upper and lower rollers which are turning in the direction of catching them.

Another object of the present invention is to extract immediately from the apparatus alien substances such as empty cans, scrap irons, stone, etc. which cannot be dewatered between rollers by loosening the compressing force of the upper and lower rollers and thereby preventing the apparatus from breaking.

A further object of the present invention is to detect any alien substance in such a manner that the required "closed" moving time of a movable chute which achieves a preliminary dewatering is preset and the existence of any alien substance is detected by moving of the movable chute over a preset time.

A still further object of the present invention is to shorten the moving time of the movable chute which achieves the preliminary dewatering upon detecting the supply of screenings and the like into the movable chute in excess of a specified quantity, thereby improving the preliminary dewatering ability and carrying out a smooth dewatering treatment.

In the conventional roller system dewatering machine, screenings and the like are supplied between upper and lower rollers as they slide on a chute and are caught in between the rollers by turning of the rollers. However, screenings include various kinds of articles and if the compressing force between rollers is constant, substances which cannot be dewatered, such as stone, iron scraps, chips of wood, etc. will block turning of the rollers. This will result in overheating of the motor which is driving the rollers or some parts of the machine being damaged. Also, if the compressing force of the rollers is loosened, dewatering efficiency will be lowered.

Figure 1A:
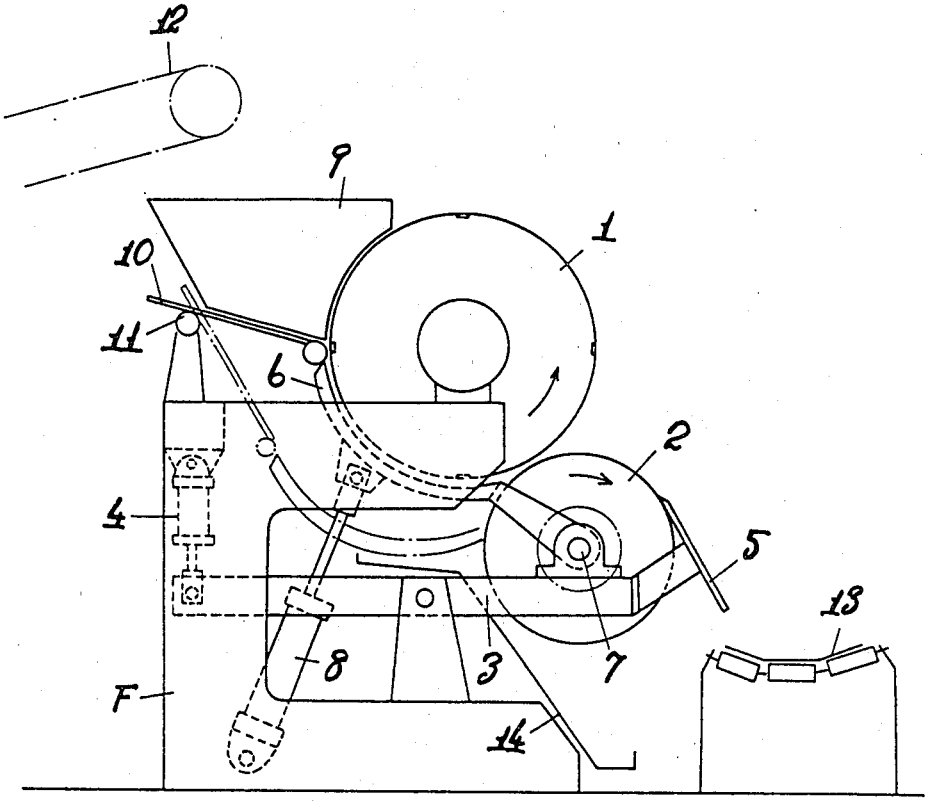
Figure 1B:
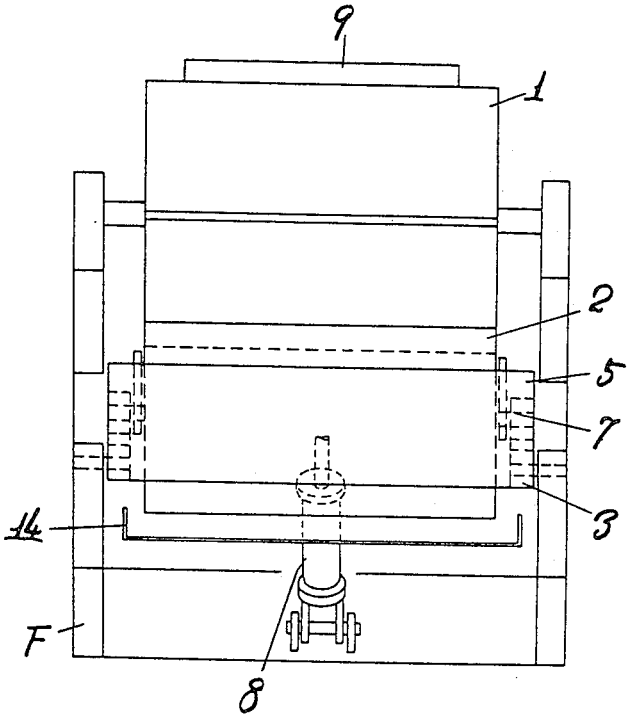

The present invention has been made to eliminate the disadvantages of the conventional dewatering machine. The nature and advantages of the present invention are described below with reference to a preferred embodiment and accompanying drawings, in which:

FIGS. 1A and 1B represent a schematic diagram of a screenings dewatering apparatus according to the present invention, in which FIG. 1A is a side view and FIG. 1B is a plan view.

Figure 2A:
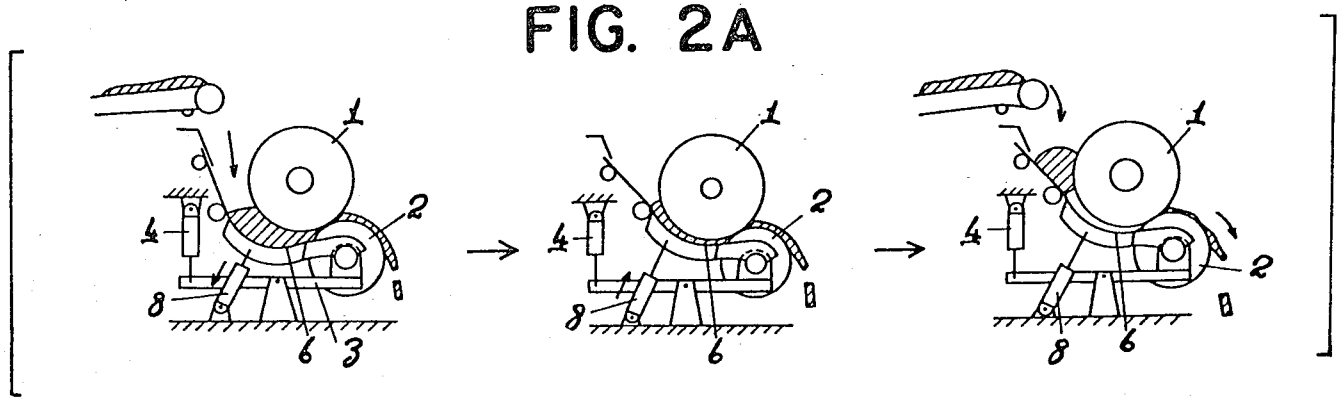
Figure 2C:
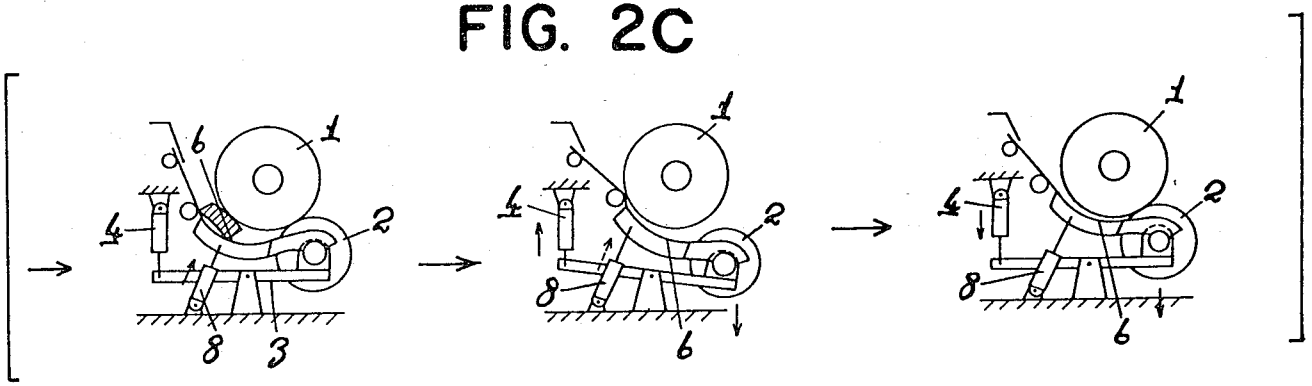
Figure 2B:
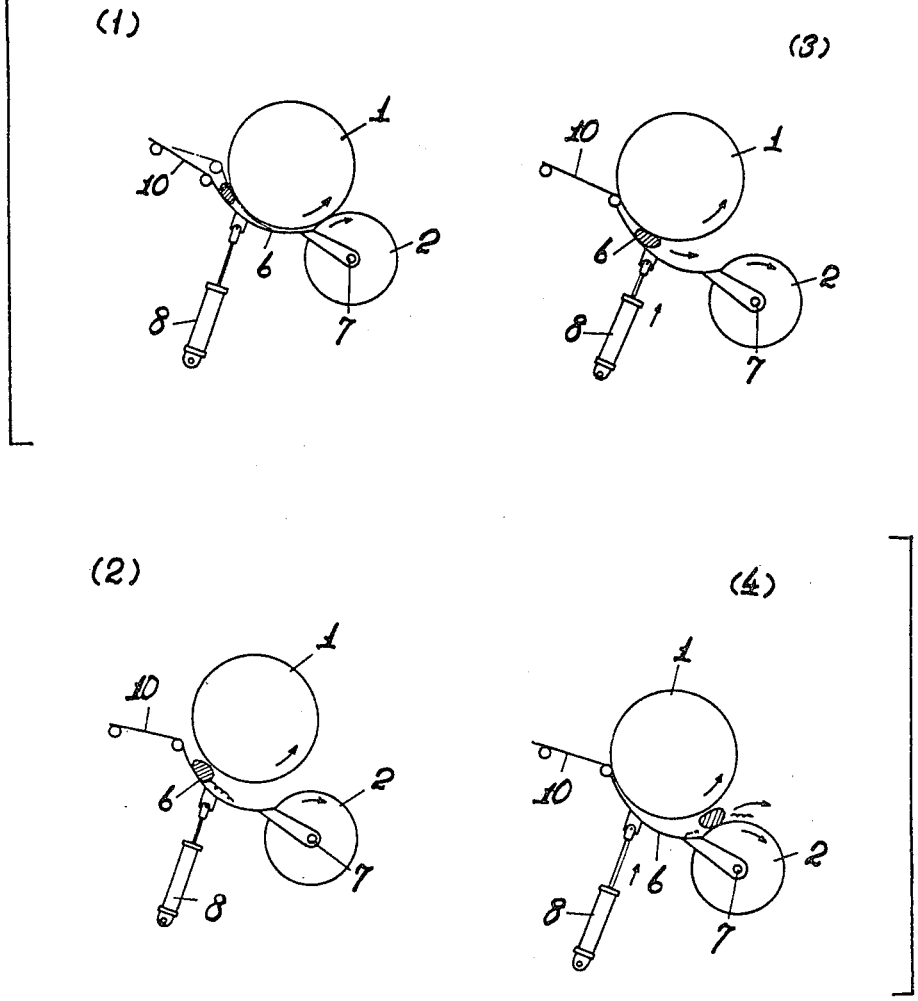

FIGS. 2A, 2B and 2C represent explanatory drawings illustrating a screenings dewatering method by upper and lower rollers, in which FIG. 2A shows the case of normal operation, FIG. 2B shows the method of extracting immediately any alien substance caught in a movable chute by separating temporarily upper and lower rollers and then pressing the lower roller against the upper roller at a weak pressure, and FIG. 2C shows the method of extracting immediately any alien substance caught in a movable chute by weakening both the pressing force of the movable chute against the upper dewatering roller and the compressing force between upper and lower rollers.

Figure 3:
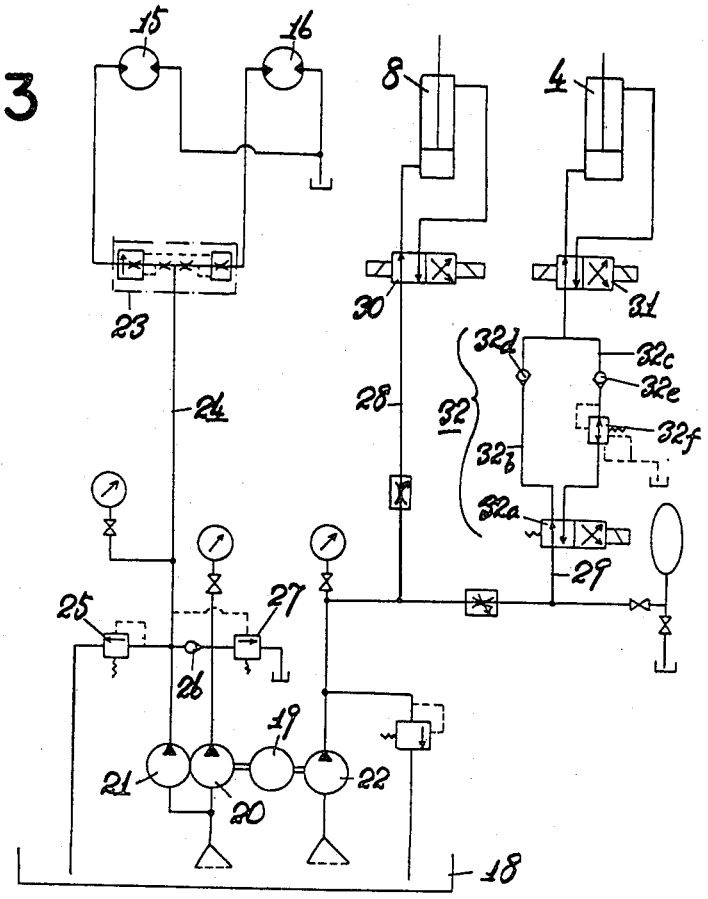
Figure 4:
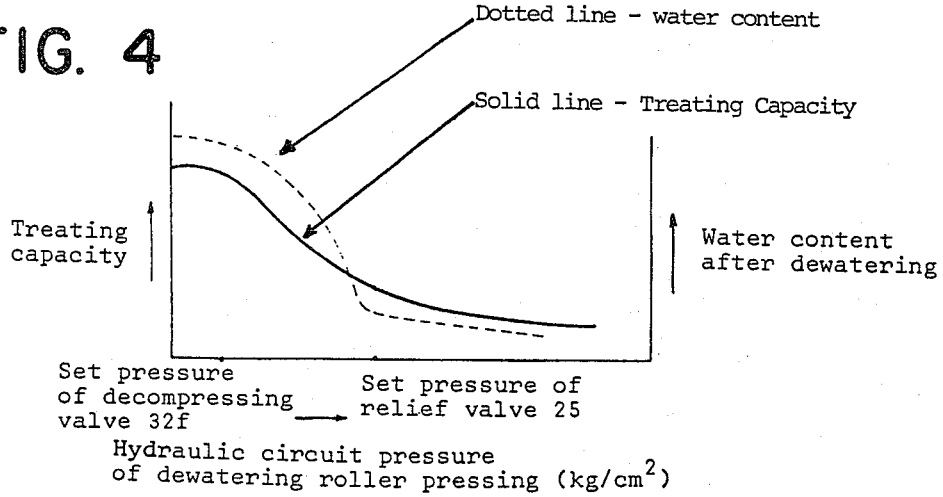
Figure 5:
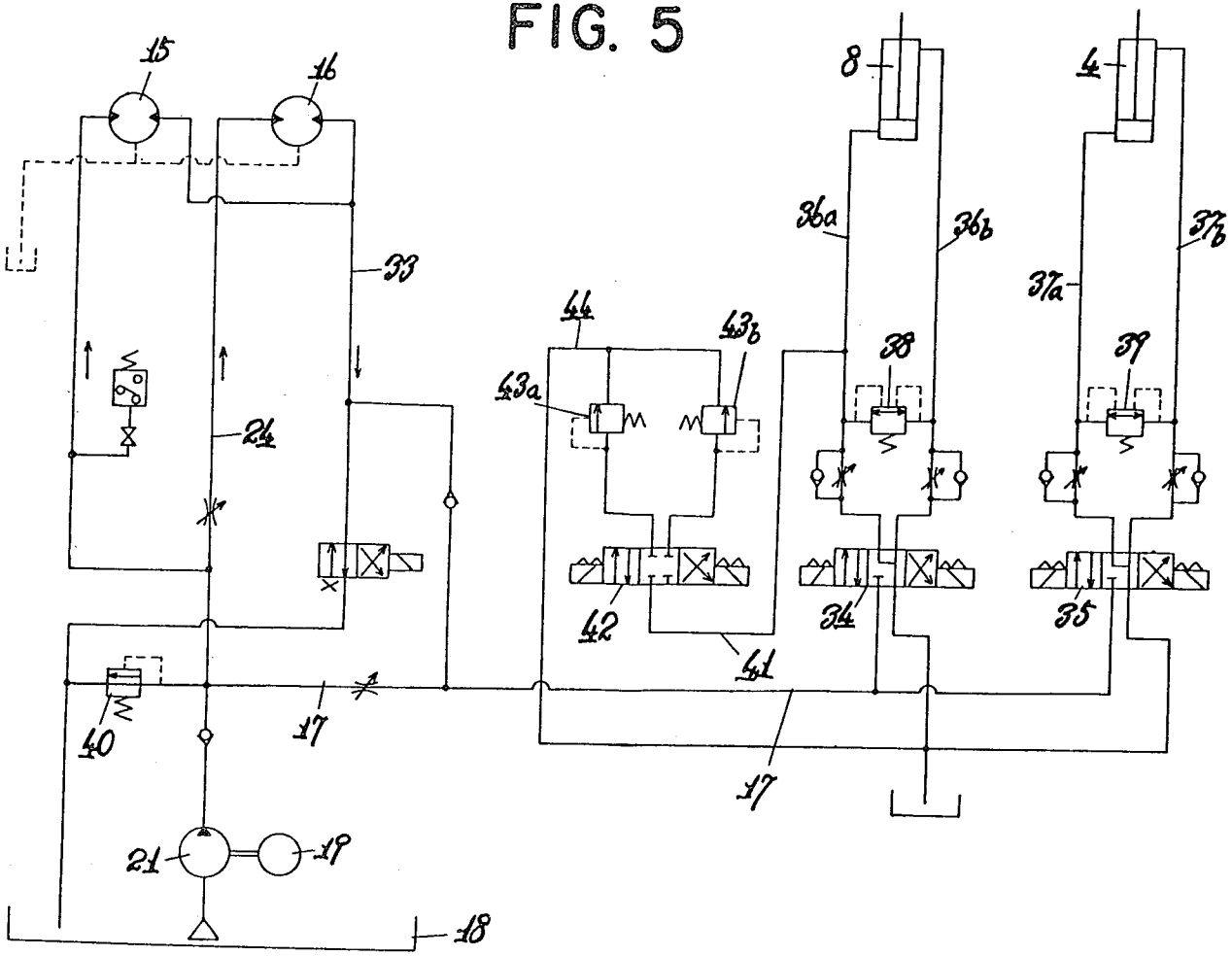

FIG. 3 is a hydraulic circuit diagram showing the operation of a dewatering apparatus, whereby when screenings supplied in a movable chute exceed the dewatering capacity the moving time of the movable chute is shortened so as to raise temporarily the dewatering capacity;

FIG. 4 shows the relationship between the treating capacity and the compressing force of the dewatering rollers in the embodiment shown in FIG. 3; and FIG. 5 is a hydraulic circuit diagram showing the method of dewatering, whereby upon detecting the mixing-in of any alien substance, pressing force of the movable chute against the roller surface is weakened and upper and lower rollers are separated from each other to extract said alien substance immediately.

Figure 7:
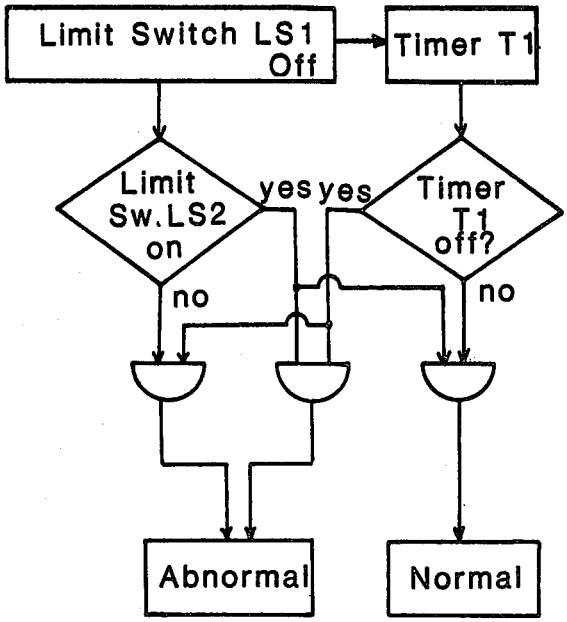
Figure 6:
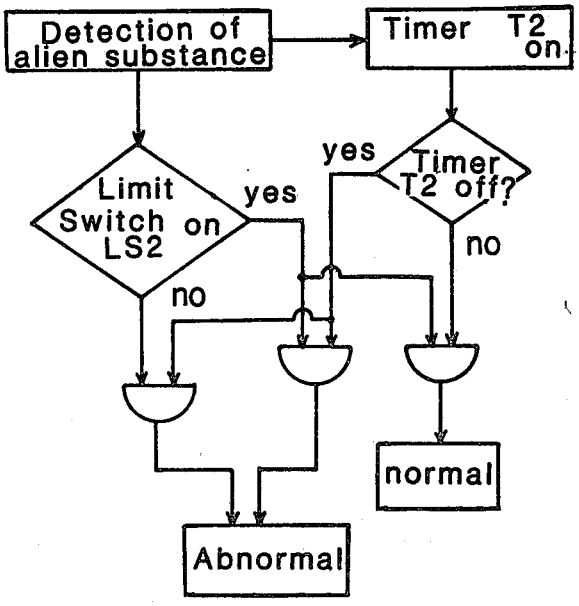

FIG. 6 and FIG. 7 illustrate the feature of the timers $T_1$ and $T_2$.

Referring to FIGS. 1A and 1B, numeral 1 denotes an upper dewatering roller and numeral 2 denotes a lower dewatering roller in contact with the outer circumference of said upper dewatering roller 1 at the required pressure. The lower dewatering roller 2 is arranged in contact with the upper dewatering roller 1 in such a fashion that it is backward at a certain angle in relation to the vertical line passing the center of an axis around which the upper dewatering roller 1 is supported rotatably. By this arrangement, refuse and water are separated between the upper and the lower dewatering rollers. The upper dewatering roller 1 is supported rotatably by the frame F of the dewatering apparatus. The lower dewatering roller 2 is provided rotatably at one end portion of an arm 3. Provided at one extreme end of the arm 3 is a scraper 5 which is in contact with the outer circumferential surface of the lower dewatering roller 2 and scrapes off screenings and the like stuck to the lower dewatering roller.

Provided under the upper dewatering roller 1 and close to a part of the outer circumference of said upper dewatering roller 1 is a chute 6 of arcuate shape. One end of the chute 6 is fitted movably to the arm 3 pivotally secured to the frame F through the medium of an axis 7. Engaged with this chute 6 is a rod of a cylinder 8 fitted to the frame F. It is so designed that by the operation of the cylinder 8 the chute 6 is forced to press against the outer circumferential surface of the upper dewatering roller 1 to effect a preliminary dewatering. The chute 6 is of arcuate shape and has a length extending from a hopper 9 up to the position where the upper dewatering roller 1 and the lower dewatering roller 2 make contact via the lower circumferential surface of the upper dewatering roller 1. The chute 6 carries at the top end thereof an introducing chute 10 through the medium of a hinge. The introducing chute 10 is supported movably by a support roller 11 provided protrudingly on the frame F. The hopper 9 to supply screenings and the like to the dewatering apparatus and an intake conveyor 12 are arranged above the introducing chute 10. Numeral 13 is an out-take conveyor to take out dewatered screenings and the like and numeral 14 is a water-receiving chute.

Referring to FIG. 1A, FIG. 1B, FIG. 2A and FIG. 2B, screenings and the like supplied into the hopper 9 from the intake conveyor 12 drop on the introducing chute 10 from the lower part of the hopper 9. At this time, the chute 6 is put in such a state that it is separate from the outer circumferential surface of the upper dewatering roller 1, namely, in "opened" state, by the operation of the cylinder 8. When the screenings and the like are supplied onto the chute 6, the cylinder 8 pushes up the chute 6 to the upper dewatering roller surface to effect the preliminary dewatering and reduce the bulk of the screenings and the like to the specified degree. Then the screenings and the like are supplied to the space between upper and lower dewatering rollers, where they are dewatered secondarily by the compressing force of both rollers. If, at this time, lumps such as stone, chips of wood, etc. are mixed in the screnings and the like, the chute 6 is not pushed up to the regular position as shown by FIG. 2B, even if it is pushed to the outer circumferential surface of the upper dewatering roller 1 by the operation of the cylinder 8, namely, the lumps are kept sandwiched between the roller and the chute and the cylinder 8 does not effect the regular stroke. The time of the regular stroke is detected by a timer or the like and as shown by FIG. 2B (3), the cylinder 4 is actuated to move the lower dewatering roller 2 downward and separate it from the upper dewatering roller 1, thereby making a gap between both rollers. This can also be detected by the raising of oil pressure of the cylinder 8. Upon detecting existence of the lumps, the cylinder 8 is pressed lightly, whereby the lumps are moved in the rotational direction of the upper dewatering roller and drop onto the taking-out conveyor 13, passing through the gap between both rollers, and are taken out.

When screenings and the like supplied from the hopper 9 contain no lumps, such as stone, chips of wood, etc. as shown by FIG. 2A, the screenings and the like are preliminarily dewatered by means of the chute 6 being pressed against the upper dewatering roller surface and then are caught between upper and lower dewatering rollers which are turning in the direction of catching them and are dewatered secondarily.

The hydraulic circuit diagram shown in FIG. 3 is for turning the upper and lower dewatering rollers by hydraulic motors 15, 16 and shows an example of the case where screenings of a quantity exceeding the dewatering capacity are supplied in the movable chute, the moving time of the movable chute is shortened so as to increase its treating capacity temporarily to cope with the oversupply of screenings.

The upper dewatering roller 1 and the lower dewatering roller 2 shown in FIG. 1A are driven respectively by individual hydraulic motors 15, 16. The movable chute 6 is adapted to separate from and press against the upper dewatering roller by means of the hydraulic cylinder 8 and the lower dewatering roller 2 is adapted to press against the upper dewatering roller by means of the hydraulic cylinder 4 at the required pressure which can be varied. Supply of oil to the hydraulic motors 15, 16 and hydraulic cylinders 8, 4 is effected by driving simultaneously hydraulic pumps 20, 21 which supply oil to the hydraulic motor side to be driven by an electric motor 19 from an oil tank 18 and a hydraulic pump 22 which supplies oil to the hydraulic cylinder side. Discharge oil from each of hydraulic pumps 20, 21 is joined together and then branched to each of hydraulic motors 15, 16 via a branch valve 23 which branches at a fixed ratio (or variable ratio).

Discharge oil from two hydraulic pumps 20, 21 of regular discharge type is joined together into an oil supply pipe 24. Branched from the oil supply pipe 24 is a relief valve 25 which sets the maximum oil pressure of the hydraulic motor to turn the dewatering roller at the allowable safety value. A check valve 26 is provided at the intermediate point of the joining of discharge oil from hydraulic pumps 20, 21 so as to prevent discharge oil from the hydraulic pump 21 from flowing into the hydraulic pump side 20. The check valve 26 is provided with a relief valve 27 which works at a pressure lower than the maximum allowable pressure set by the relief valve 25. Discharge pressure oil from the hydraulic pump 22 is supplied to each of the hydraulic cylinder 8 for the movable chute and the hydraulic cylinder 4 for pressing the lower dewatering roller via two hydraulic circuits 28, 29. These hydraulic circuits 28, 29 are provided with electromagnetic switch valves 30, 31 respectively so that pressure oil from each hydraulic circuit is supplied to either the pressing side or the separating side as required by switching. The hydraulic circuit 29 is provided with a hydraulic variable circuit 32 for varying oil pressure so as to adjust stepwise the pressing force by the hydraulic cylinder 4.

The hydraulic variable circuit 32 is connected to two oil passages **32*b*, 32*c* which are in parallel from the hydraulic circuit 29 via an electromagnetic valve 32*a*, so as to provide each oil passage with check valves 32*d*, 32*e* respectively. The oil passage 32*c* is provided with a decompressing valve 32*f* which is in series with the check valve 32*e*. The decompressing valve 32*f* is for reducing the pressing force of the lower dewatering roller to the specified level. In FIG. 3, when the motor 19 is started, hydraulic pumps 20, 21 are turned and oil is supplied from hydraulic pumps 20, 21 to hydraulic motors 15, 16 via the branching valve 23, whereupon upper and lower dewatering rollers 1 and 2 turn at the predetermined torque and speed and, at the same time, oil is supplied from the hydraulic pump 22 to hydraulic cylinders 8, 4 via hydraulic circuits 28, 29 respectively, whereupon the movable chute 6 is moved by switching over at the regular cycle the electromagnetic valve 30 provided in the hydraulic circuit 28 and thus the lower dewatering roller is pressed against the upper dewatering roller at the predetermined pressure. If screenings and the like are fed in the movable chute in this state, they are dewatered preliminarily by the pressing and separating action of the movable chute in relation to the upper dewatering roller side, are decreased in bulk, and then dewatered secondarily between upper and lower dewatering rollers. Screenings and the like thus dewatered are taken out via an out-take chute. In this way, screenings and the like of the predetermined quantity are supplied continuously or intermittently and then dewatered automatically. However, when screenings and the like of the quantity exceeding the dewatering capacity per unit time are supplied, there is a fear that unforeseen trouble such as inability of dewatering or stoppage of operation, may occur. In order to prevent such trouble, the apparatus is so designed that upon detecting the supply of screenings and the like in excess of the dewatering capacity the electromagnetic valve 32*a* is made ON, whereupon the flowing direction of oil is changed from the oil passage 32*b* over to the oil passage 32*c*. Since the oil passage 32*c* is provided with a decompressing valve 32*f* which is adapted to work at a pressure lower than the required pressing force of the lower dewatering roller, oil pressure in the oil passage 32*c* lowers to the set pressure of the decompressing valve 32*f* and thus the pressing force of the lower dewatering roller is weakened, at the same time, the switching interval of the electromagnetic valve 30 provided at the hydraulic circuit 28 is shortened by the timer so as to quicken the moving cycle of the movable chute. In this way, by the frequent moving of the movable chute and by weakening of the compressing force between dewatering rollers, the quantity of screenings passing through dewatering rollers per unit time is increased to prevent the danger of the dewatering apparatus becoming unworkable. In this case, the dewatering efficiency lowers as shown by FIG. 4 but such phenomenon is of temporary nature and when the screenings supply quantity passes its peak, pressing force of the dewatering rollers and the moving cycle of the movable chute return respectively to the predetermined pressing force and cycle, and the desired dewatering is continued. In FIG. 4**, the dotted line curve shows the percentage of water content and the solid line curve shows the treating capacity.

Next, an explanation is set forth about the method whereby upon detecting the mixing-in of any alien substance, the pressing force of the movable chute against the roller surface is weakened and the upper roller and the lower roller are urged to separate from each other to take out such alien substance immediately. This method is shown in FIG. 5 in terms of the hydraulic circuit diagram.

The oil pump 21 which is driven by the motor 19 and an oil supply pipe 24 are connected to an oil tank 18. The oil supply pipe 24 is branched into two, each supplying oil to the hydraulic motor 15 and the hydraulic motor 16 respectively via a flow control valve which controls the revolution speed of said motors. Hydraulic liquid (oil) from hydraulic motors 15, 16 is joined together and is returned to the oil tank 18 via one oil discharge pipe 33. An oil supply pipe 17 branched from the oil supply pipe 24 is extended to be connected to electromagnetic type direction switch valves 34, 35 which operate the hydraulic cylinder 8 for moving the movable chute and the cylinder 4 for moving the lower dewatering roller. Two oil pipes 36*a*, 36*b* are provided between the cylinder port of the switch valve 34 and the cylinder 8, and two oil pipes 37*a*, 37*b* are provided between the direction switch valve 35 and the cylinder 4. A safety valve 38, which becomes ON when the predetermined pressure is reached, is provided between oil pipes 36*a*, 36*b* in such a fashion that these pipes are directly connected. Similarly, a safety valve 39 is provided between oil pipes 37*a* and 37*b*. These two safety valves 38, 39 and another safety valve 40 provided between the branched discharge oil pipe and the oil tank are adjusted previously so that they work at the same pressure or the safety valve 40 works at a pressure a little higher than the other two safety valves 38, 39.

A branch oil pipe 41 provided from the oil pipe 36*a* is connected to a direction switch valve 42. A cylinder port of the direction switch valve 42 is provided with relief valves 43*a*, 43*b* for which a discharge pipe 44 communicating with the oil tank is provided.

For working the dewatering apparatus of the above-described construction, firstly the motor 19 is made ON to drive the hydraulic pump 21, whereupon hydraulic liquid is supplied from the oil tank 18 to the hydraulic motors 15, 16 via the oil supply pipe 17, a branched oil supply pipe and the flow control valve, and both hydraulic motors 15, 16 turn at the predetermined speed to rotate upper and lower dewatering rollers 1, 2. Hydraulic liquid which has passed the hydraulic motors 15, 16 is returned to the oil tank via the oil discharge pipe 33. Oil is supplied to the side of hydraulic cylinders 8, 4 at the same time via the oil supply pipe 17, but the electromagnetic switch valve 35 is in ON state so that the hydraulic cylinder 4 is pressed against the upper dewatering roller side at the predetermined pressure and the hydraulic cylinder 8 switches automatically the electromagnetic switch valve 34 at the predetermined cycle, making the movable chute to repeat the action of pressing against the upper dewatering roller surface and releasing of the pressing. Thus, preliminary dewatering of screenings supplied into the movable chute is effected by moving of the movable chute. Preliminarily dewatered screenings are then transferred from the movable chute to between the upper and lower dewatering rollers where secondary dewatering is effected. Such a dewatering process by the normal operation is carried out on continuous basis.

When alien substances which cannot be dewatered, such as chips of wood, stone, etc. are put in the movable chute, the alien substances are caught between the movable chute 6 and the upper dewatering roller and the movable chute 6 will not move to the predetermined position even though it is pressed by the hydraulic cylinder. The time required for the movable chute to shift from its "open" state to its "closed" state is predetermined and a timer $T_1$ shown in FIG. 6 is put in operation upon starting of the moving of the movable chute. If the movable chute does not reach the predetermined position within the time set in timer, this indicates mixing-in of alien substances. Thus, existence of any alien substance is detected through the time setting of the timer $T_1$ and the electromagnetic switch valve 34 actuates the electromagnetic valve 42 as the movable chute is held in "closed" direction, whereby supply oil pressure is reduced to the level of the predetermined weak pressure of the relief valve 43*a* and in consequence, the pressing force of the movable chute against the dewatering roller surface is lowered and oil feeding pressure to the hydraulic cylinder 4 is reduced, or, pressing force of the lower dewatering roller is weakened by switching the electromagnetic switch valve 35 to stop the oil supply and releasing hydraulic liquid on the pressing side, whereby both dewatering rollers are separated from each other as shown by FIG. 2B (4) and the hinge of the movable chute is made to contact with the upper roller and alien substances in the movable chute are taken out immediately. When the existence of any alien substance is detected, another timer $T_2$ shown in FIG. 7 is actuated and if the movable chute does not take out any alien substance and is not closed within the time set by the timer $T_2$, this indicates that such alien substance remains in the movable chute or between both dewatering rollers and therefore the timer $T_2$ indicates time setting, whereby trouble is detected. The timers can, for example, be activated and deactivated by limit switches actuated by movement of the movable chute.

According to the present invention, screenings are preliminarily dewatered by pressing a movable chute against the outer circumferential surface of the upper dewatering roller before they are dewatered between upper and lower dewatering rollers at the required pressure and smooth operation of the dewatering apparatus is ensured even when alien substances such as stone, chips of wood, etc. which cannot be dewatered are mixed in or even when screenings of the quantity exceeding the dewatering capacity are supplied, by proper adjustment of the moving time of the movable chute, pressing force of the movable chute and the compressing force between upper and lower dewatering rollers.

What we claim is:

1. A method of dewatering screenings comprising the steps of: a preliminary dewatering by pushing a movable chute on which screenings are supplied against the outer circumferential surface of an upper dewatering roller and a secondary dewatering by compressing the preliminarily dewatered screenings between an upper dewatering roller and a lower dewatering roller which is arranged in such a position that it is backward at a certain angle in relation to the vertical line passing the center of the axis of the upper dewatering roller, both rollers being turned in the direction of catching screenings therebetween.

2. A method of dewatering screenings comprising the steps of: a preliminary dewatering by pushing a movable chute on which screenings are supplied against the outer circumferential surface of an upper dewatering roller and a secondary dewatering by compressing the preliminarily dewatered screenings between an upper dewatering roller and a lower dewatering roller which is arranged in such a position that it is backward at a certain angle in relation to the vertical line passing the center of the axis of the upper dewatering roller, both rollers being turned in the direction of catching screenings therebetween and wherein any alien substance such as stone, chips of wood, etc. mixed in screenings is detected automatically during the preliminary dewatering step by the timing of the moving time of the movable chute set by a timer, in response to which the pressing force of the movable chute against the dewatering roller surface is weakened and the compressing force between said upper and lower dewatering rollers is released so as to discharge such alien substance immediately from the apparatus.

3. A method of dewatering screenings comprising the steps of: a preliminary dewatering by pushing a movable chute on which screenings are supplied against the outer circumferential surface of an upper dewatering roller and a secondary dewatering by compressing the preliminarily dewatered screenings between an upper dewatering roller and a lower dewatering roller which is arranged in such a position that it is backward at a certain angle in relation to the vertical line passing the center of the axis of the upper dewatering roller, both rollers being turned in the direction of catching screenings therebetween and wherein a supply of screenings in a quantity exceeding the specified treating capacity is detected automatically, in response to which the compressing force between the upper and the lower rollers is weakened and the moving cycle of the movable chute in relation to the outer circumferential surface of the upper dewatering roller is shortened so as to increase temporarily the treating capacity.

4. A method of dewatering screenings comprising the steps of: a preliminary dewatering by pushing a movable chute on which screenings are supplied against the outer circumferential surface of an upper dewatering roller and a secondary dewatering by compressing the preliminarily dewatered screenings between an upper dewatering roller and a lower dewatering roller which is arranged in such a position that it is backward at a certain angle in relation to the vertical line passing the center of the axis of the upper dewatering roller, both rollers being turned in the direction of catching screenings therebetween wherein a timer is actuated upon detecting of any alien substance and when the movable chute does not discharge such alien substance within the time set by the timer, retention of such alien substance in the movable chute or between the upper and the lower dewatering rollers is thereby detected by the time setting of the timer.

5. An apparatus for dewatering screenings comprising an upper dewatering roller, a lower dewatering roller arranged in such a position that it is backward at a certain angle in relation to the vertical line passing the center of an axis of said upper dewatering roller and in such a fashion that it contacts variably with said upper dewatering roller by a hydraulic cylinder connected to a hydraulic circuit of a hydraulic motor, both dewatering rollers being driven by a hydraulic motor in the direction of catching screenings therebetween for the secondary dewatering, and a movable chute adapted to carry out a preliminary dewatering by pushing screenings thereon against the outer circumferential surface of said upper dewatering roller at a predetermined pressure by operating the hydraulic cylinder from a part of the hydraulic circuit to the hydraulic motor, thereby reducing the bulk of screenings to facilitate catching of screenings by upper and lower dewatering rollers.

* * * * *